United States Patent [19]

Vieau et al.

[11] Patent Number: 4,507,897

[45] Date of Patent: Apr. 2, 1985

[54] GRINDING HEAD ASSEMBLY

[75] Inventors: Robert G. Vieau, Plymouth; William D. Klempke, Brooklyn Park, both of Minn.

[73] Assignee: Loram Maintenance of Way, Inc., Hamel, Minn.

[21] Appl. No.: 450,913

[22] Filed: Dec. 20, 1982

[51] Int. Cl.[3] ..... B24B 45/00; B24D 7/02

[52] U.S. Cl. ..... 51/209 R; 51/168

[58] Field of Search ..... 51/206, 207, 209 R, 51/168, 178, 358, 376, 389, 390, 206.4, 209 S, 209 DL, 378; 15/180, 181; 125/3

[56] References Cited

U.S. PATENT DOCUMENTS

| | | | |
|---|---|---|---|
| 1,079,304 | 11/1913 | Spencer . | |
| 1,476,515 | 12/1923 | Howard | 51/209 DL |
| 1,767,821 | 6/1930 | Thompson . | |
| 1,832,515 | 11/1931 | Webster . | |
| 1,856,321 | 5/1932 | Doermann . | |
| 2,023,041 | 12/1935 | Ballash et al. | 51/209 R |
| 2,038,727 | 4/1936 | Geyer . | |
| 2,065,942 | 12/1936 | Lane . | |
| 2,099,179 | 11/1937 | Stainbrook | 51/209 R |
| 2,110,619 | 3/1938 | Beth . | |
| 2,201,410 | 5/1940 | Simonds | 51/209 R |
| 2,268,663 | 1/1942 | Kuzmick | 51/207 |
| 2,353,864 | 7/1944 | Wooddell . | |
| 2,479,078 | 8/1949 | Milligan et al. . | |
| 2,720,733 | 10/1955 | Ballash | 51/209 R |
| 2,806,331 | 9/1957 | Hoye . | |
| 2,958,166 | 11/1960 | Foland . | |
| 3,256,646 | 6/1966 | Mockli | 51/209 R |
| 3,290,834 | 12/1966 | Lindblad . | |
| 3,707,808 | 1/1973 | Danko et al. | 51/178 |
| 3,844,072 | 10/1974 | Haigh et al. . | |
| 3,866,361 | 2/1975 | Mauck | 51/378 |
| 3,936,981 | 2/1976 | White . | |
| 3,986,593 | 7/1975 | Rine . | |
| 4,292,768 | 10/1981 | Panetti . | |

FOREIGN PATENT DOCUMENTS

| | | | |
|---|---|---|---|
| 512530 | 11/1930 | Fed. Rep. of Germany | 51/209 S |
| 710945 | 6/1931 | France | 51/379 |
| 1107254 | 12/1955 | France | 51/209 R |

*Primary Examiner*—Frederick R. Schmidt
*Assistant Examiner*—Robert A. Rose
*Attorney, Agent, or Firm*—Dorsey & Whitney

[57] ABSTRACT

A grinding head assembly for use in maintaining railroad tracks. The invention is typically used in longitudinally spaced series to grind the surface of the rails to remove corrugations, to restore a smooth regular travel surface. The grinding head assembly is characterized by an annular backing plate and grinding wheel designed for ease of mounting and maximum use of the grinding wheel.

4 Claims, 8 Drawing Figures

GRINDING HEAD ASSEMBLY

BACKGROUND OF THE INVENTION

1. Field of the Invention

This invention relates to a grinding head assembly characterized by an improved backing plate for mounting a grinding wheel, typically used to remove surface corrugations in railroad tracks.

2. Description of the Prior Art

Routine maintenance of railroad tracks includes grinding the surface of the rail to remove corrugations to restore a smooth, regular travel surface. Corrugations result from prolonged passage of rail cars over the rails, especially at curves. Elsewhere, corrugations appear in association with defective joints.

It is usual to pass a grinding machine which has longitudinally spaced multiple grinding heads over each rail. Generally, each grinding head has a grinding wheel attached to a holder. The holder is attached to a vertically disposed rotatable drive shaft which is driven by a motor. The grinding head is lowered until the plane surface of the grinding wheel is in contact with the surface of the rail. The head is rotated, creating a grinding motion on the surface of the rail, and the machine is moved along the railroad track to continuously grind lengths of the rail surface as the grinding head passes over it.

Grinding heads are typically rotated at 3600 rpm. It is essential that the holder and grinding wheel withstand the stresses associated with rotation at such a speed. In the prior art the effect of grinding stresses has been reduced by constructing a holder of multiple sections. This multiple section construction increases production and installation costs. There is a need in the art for a wheel holder of simple design that provides the rigidity necessary to withstand rotational stress while keeping cost of production and installation at a minimum.

Because of the rotational speed and associated centrifugal stresses, the component parts of the grinding head must be balanced if the head is to perform correctly. To achieve this, the wheel holder and grinding wheel must be accurately centered with respect to the axis of the drive shaft, the wheel holder, and with respect to each other. Two prior art patents disclose means to center the backing plate on the backing plate holder. Spencer (U.S. Pat. No. 1,079,304) and Panetti (U.S. Pat. No. 4,292,768) each disclose backing plates which are formed to mate and register coaxially with backing plate holders. The Panetti design is more complex than the Spencer design, but in Spencer as well as Panetti both the backing plate and backing plate holder must be specially cast, increasing production costs. In the Panetti design seating and centering of the backing plate is inconvenient because of the need to interlock two fairly complex surfaces under low visibility conditions. Even with the Spencer design a person installing or replacing the backing plate might anticipate some difficulty in seating and centering the plate on the holder. There is therefore a need for a simple and effective method to ensure automatic centering of the backing plate to diminish the time and cost of installation and replacement, and to reduce the cost of production.

Grinding wheels have been fastened to backing plates in the prior art by molding the wheel to the plate and by attaching the wheel to the plate with adhesive or nuts and bolts. If the wheel is molded to the plate, centering can be achieved by rotation of the backing plate during the molding process. Other centering means are needed if the wheel is to be attached by adhesive. Applicant knows of no prior art addressing that problem. There is therefore a need for a centering means that ensures that the grinding wheel is co-axially positioned relative to the backing plate so that the wheel-plate combination is in balance.

The process of installation and replacement of the component parts of a grinding head is complicated by their size and weight. There is danger of personal injury in handling bulky, heavy objects and the time involved in assembly or service is increased by the difficulty in handling the parts.

Panetti discloses a grinding head design that attempts to alleviate some of the difficulty in installation. A metal backing plate 7, integral with a grinding wheel 6, has notches 14, the edges of which engage retaining studs 16 on a support flange 1, to hold the assembly in place for clamping.

However, as has already been pointed out, the complex backing plate in Panetti must be interlocked with the complex backing plate holder, while their two surfaces are not visible to the installer, before the holding facility created by the stud and notch design can be utilized. Also, once the backing plate and grinding wheel are held in place their attachment to the backing plate holder is achieved by an additional component, a central clamping flange 9 which is held on the drive shaft by a screw 10. This flange and screw must be completely removed before a replacement wheel and backing plate can be installed. Thus, despite the facility of holding the wheel and backing plate combination during clamping, installation and replacement continues to be time-consuming and physically difficult.

There is therefore a need for grinding head components that can be easily and rapidly installed and serviced with minimal disassembly, for both safety and economic reasons.

Economics also requires maximum use from each component of the grinding head, particularly the grinding wheel. Thus, the design of the head should permit use of the abrasive material of the grinding wheel to the maximum extent or depth possible.

SUMMARY OF THE INVENTION

The present invention comprises a grinding head assembly characterized by a backing plate that enables quick and easy installation and replacement of the grinding section of the head. The backing plate assembly is of simple and economic construction and withstands the stresses associated with the grinding process. It can be automatically centered to ensure balance, allows use of a grinding wheel to its maximum or near maximum depth and may be reused once the abrasive material of the grinding wheel is exhausted.

An annular backing plate which has an annular grinding wheel fastened to it has an outer upwardly flange which fits external to the outer wall of a backing plate holder and serves to automatically center the backing plate on the backing plate holder. Notches in the flange correspond with holes in the backing plate holder wall. The backing plate is held in position on the backing plate holder by bolts passing through the notches and into the holes in the backing plate holder. To install the backing plate and grinding wheel the bolts are inserted into the outer wall of the backing plate holder sufficiently to allow the flange of the backing plate to slide between the bolt heads and the outer wall of the backing plate holder. The bolts are then tightened to hold the flange against the outer wall. For replacement the bolts need only be loosened sufficiently to allow the flange to slide downwards, so that the backing plate and wheel can be separated from the backing plate holder. The backing plate holder thus remains in place during installation and replacement. Only the backing plate and attached grinding wheel are removed.

In one embodiment of the invention the grinding wheel is fastened to the backing plate by adhesive, so enabling the full depth of the grinding wheel to be utilized. Centering tabs on the backing plate can ensure automatic accurate positioning of the grinding wheel relative to the plate.

In other embodiments the grinding wheel is molded to the backing plate. Anchors on the plate minimally intrude into the material of the grinding wheel, allowing the majority of the abrasive material of the wheel to be utilized. Once the abrasive material of the grinding wheel is exhausted the residue may be chemically removed from the backing plate and the plate used again with a new grinding wheel.

The invention provides two embodiments of backing plate inner flange which increase the rigidity of the plate and enable it to better withstand stress. In one, usable with a wheel molded to the backing plate, the inner flange is downwardly directed. In the other, which can be used with a grinding wheel that is either fastened by adhesive or molded to the plate, the inner flange is upwardly directed.

As will be seen the present invention provides an automatically centered backing plate assembly that reduces time spent in installation and replacement, can withstand the stresses associated with the grinding action, allows use of the grinding wheel to maximum or near maximum depth, and is simply and economically constructed of reusable parts.

Accordingly, it is an objective of this invention to provide a backing plate assembly for a grinding head that enables easy installation and replacement of the backing plate and grinding wheel without removal of the backing plate holder or the fastening means holding the backing plate onto the backing plate holder.

It is an objective of this invention to provide a backing plate assembly that will withstand stresses associated with the grinding action.

It is an objective of this invention to provide a means to automatically center a backing plate on a backing plate holder for installation and replacement.

It is an objective of this invention to provide a means to automatically center a grinding wheel on a backing plate.

It is an objective of this invention to provide a backing plate assembly for a grinding head that enables the use of the maximum or near maximum depth of the abrasive material of the grinding wheel.

It is an objective of this invention to provide a simply constructed backing plate assembly for a grinding head with parts that are reusable once the adhesive material of the grinding wheel has been worn down.

DESCRIPTION OF THE PREFERRED EMBODIMENT

The preferred embodiment of the invention is shown in FIGS. 1–5. An annular backing plate 11 has an outer upwardly directed flange 12 and an inner downwardly directed flange 13. An annular grinding wheel 14 is molded to the backing plate 11.

Figure 1:
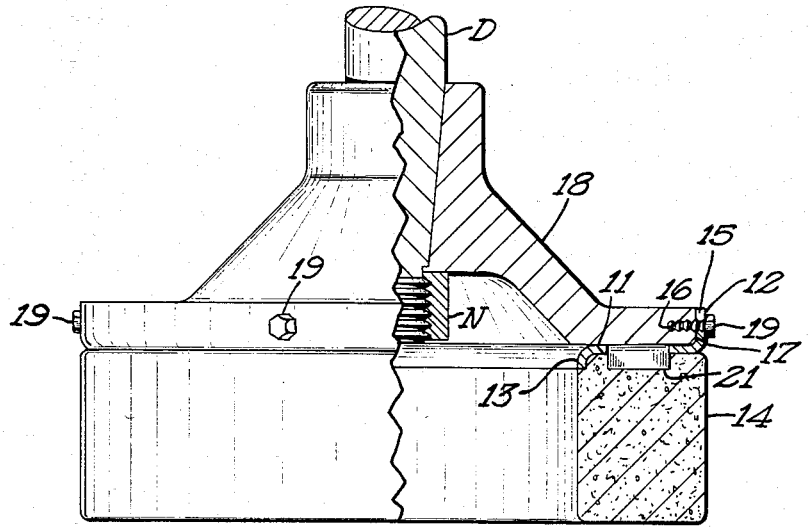
FIG. 1 is a vertical elevation, partly in section, of the backing plate assembly and drive shaft in the preferred embodiment of the invention.
Figure 2:
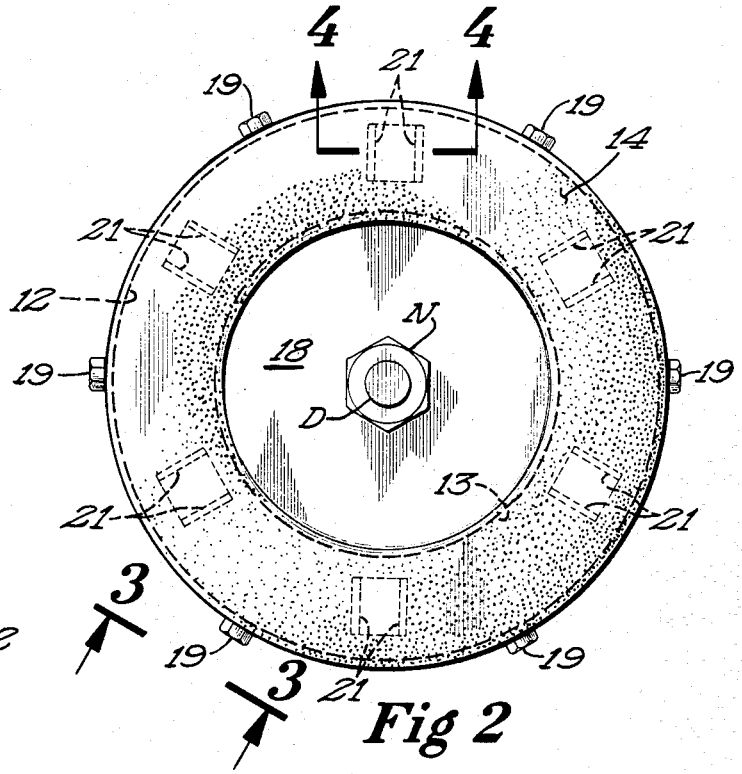
FIG. 2 is a planar view of the bottom of the backing plate assembly and drive shaft.
Figure 3:
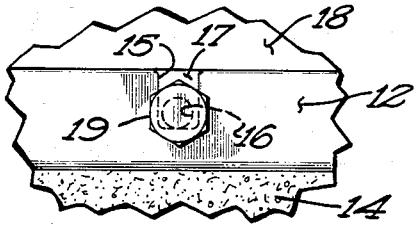
FIG. 3 shows detail of the means of fastening the backing plate to the backing plate holder in the preferred embodiment, taken along the line 3—3 of FIG. 2.

The backing plate 11 has a plurality of notches 15 (See FIG. 3) at intervals in its outer flange 12. Each notch 15 registers with threaded bore 16 in the outer wall 17 of backing plate holder 18. Referring to FIG. 3, the backing plate is fastened to the backing plate holder by bolts 19 or similar fasteners inserted through the notches 15 into threaded bore 16 in outer wall 17 of the backing plate holder 18.

Figure 4:
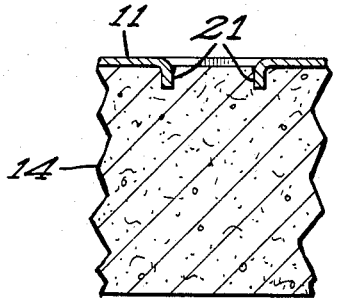
FIG. 4 shows detail of an anchor tab taken along the line 4—4 of FIG. 2.
Figure 5:
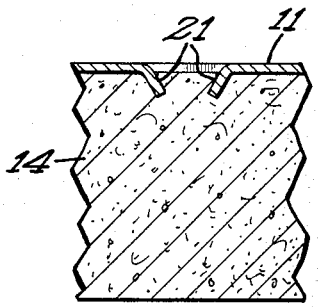
FIG. 5 shows detail of a second embodiment of an anchor tab taken along the line 4—4 of FIG. 2.
Figure 8:
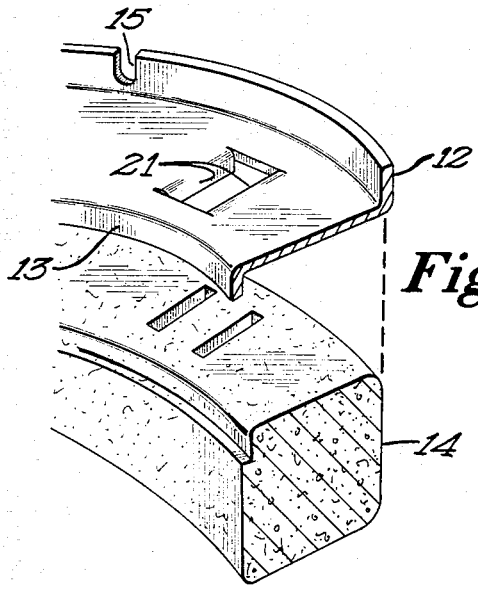
FIG. 8 is an exploded perspective view of a portion of the backing plate and grinding wheel of the preferred embodiment shown in FIG. 1.

The backing plate holder 18 has a central frustoconical bore which accepts frustoconical drive shaft D. The backing plate holder 18 is fastened to the drive shaft D by a nut N which is screwed onto the threaded lower end of the drive shaft D. Drive shaft D can be keyed or splined to backing plate holder 18 so that rotation of drive shaft D rotates backing plate holder 18 and backing plate 11. Tabs 21 in backing plate 11 are downwardly directed into the abrasive material that comprises grinding wheel 14 to transmit the rotational driving force to the grinding wheel 14. To achieve this result the tabs 21 can take a variety of forms, two of which are shown in FIGS. 4 and 5. In FIG. 4 the tabs 21 extend vertically downwardly into the grinding wheel 14. In FIG. 5 the anchor tabs 21 are angled downwardly into the grinding wheel 14.

The outer flange 12 of backing plate 11 enables both ease of attachment to backing plate holder 18 and creates a rigidity in the backing plate 11 so that backing plate 11 can better withstand rotational stresses. The backing plate 11 can be stamped out from metal sheet material or produced by casting.

In the process of molding the grinding wheel 14 to the backing plate 11 the raw form of the abrasive material that forms the grinding wheel 14 is bonded to backing plate 11 in a mold under pressure. The grinding wheel 14 is centered on the backing plate 11 during the molding process. The wheel and plate combination is then heated to cure the wheel 14 into its hard grinding state.

Figure 6:
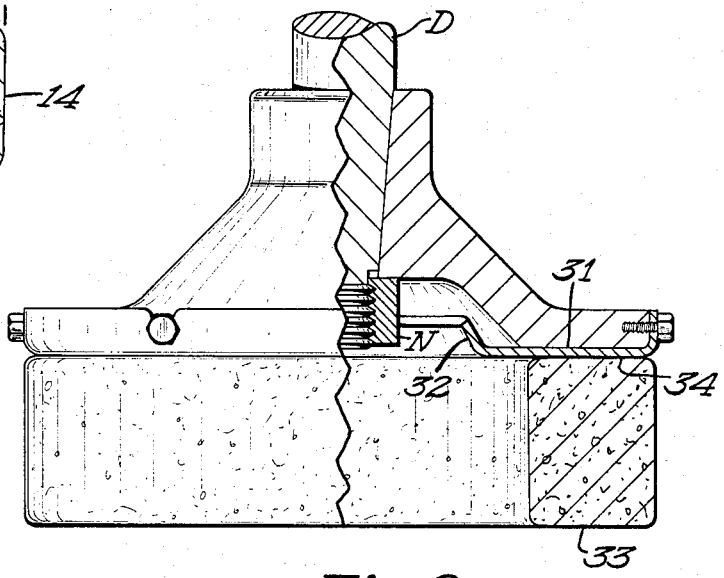
FIG. 6 is a vertical elevation, partly in section, of a second embodiment of the backing plate assembly and drive shaft, showing the inner upwardly angled backing plate flange.

Referring to FIG. 6, in a second embodiment of the invention the backing plate 31 has an inner upwardly angled flange 32 which creates an even greater rigidity in the plate 31, so increasing its ability to withstand rotational stresses. An annular grinding wheel is either molded to the backing plate as in the first embodiment, or a premolded annular grinding wheel 33 is fastened to the backing plate 31 by a layer of adhesive 34. Any adhesive material that can withstand the rotational stresses and heat generated by the grinding process is suitable to fasten the grinding wheel 33 to the backing plate 31. Adhesive #Ec 3445, thermal setting liquid adhesive manufactured by Minnesota Mining and Manufacturing Co., St. Paul, Minn. is an example of a suitable adhesive.

Figure 7:
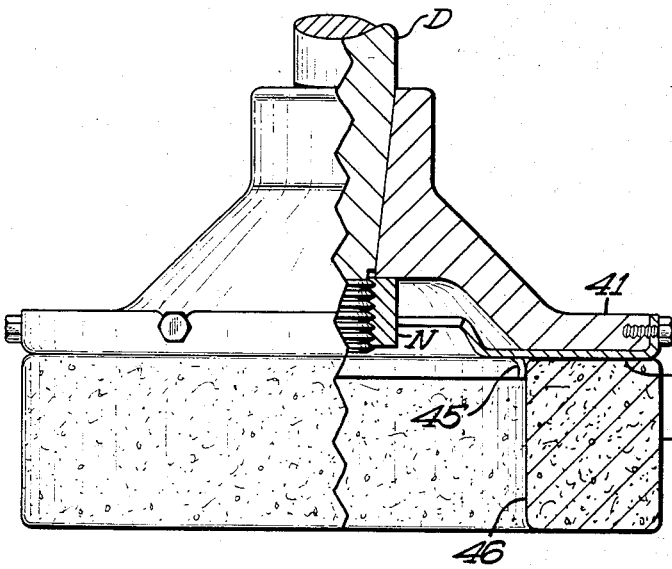
FIG. 7 is a vertical elevation, partly in section, of a third embodiment of the backing plate assembly and drive shaft, showing centering tabs.

In a third embodiment, shown in FIG. 7, a plurality of inner centering tabs 45 curve downwardly from the backing plate 1. The tabs 45 may be stamped out of the backing plate material or cast when the plate is manufactured. The cast version of the tabs 45 is illustrated in FIG. 7. Tabs 45 are positioned so as to make contact with the inner wall 46 of a premolded annular grinding wheel 43, automatically centering the wheel 43 on the backing plate 41 when it is fastened to the plate 41 by adhesive 44.

The installation and replacement procedure is the same for each embodiment described. With reference to FIGS. 1–5, in installation the backing plate holder 18 is fitted to the drive shaft D. The nut N is then screwed to the threaded end of the drive shaft D and tightened to hold the backing plate holder 18 to the drive shaft D. For easiest installation, the bolts 19 are partially screwed into the threaded bores 16 in the outer wall 17 of the backing plate holder 18.

The backing plate 11 has the grinding wheel 14 molded to it or fastened to it by adhesive before installation of backing plate 11 on backing plate holder 18. The wheel 14 is centered on the plate 11 in the molding process or during bonding. During bonding the centering is either by selective manual positioning, in the cast of the embodiment of FIG. 7, or automatically by positioning the inner wall 46 of the wheel 43 against the centering tabs 45.

The backing plate 11 is placed so that the outer flange 12 is adjacent to the outer wall 17 of the backing plate holder 18 and the notches 15 cup the stems of the bolts 19. This action automatically centers the backing plate 11 with respect to the backing plate holder 18, ensuring that the combination of wheel 14, plate 11 and holder 18 are in balance. Installation is thus rapid and easy. The installer has a clear view of the parts to be fitted together, and the notch and bolt assembly method is especially effective as the stems of the bolts serve as guides for the placement of the notches.

The bolts 9 are then tightened to hold the outer flange 12 against the outer wall 17 of the backing plate holder 18.

During use the abrasive material of the grinding wheel 14, 33 or 43 is worn away. The present invention is economically advantageous as it allows the use of the grinding wheel 14, 33 or 43 to its maximum depth or near maximum depth, depending on the embodiment chosen. In the second embodiment described, FIG. 6, where the wheel 33 is bonded by adhesive to the backing plate 31, the full depth of the wheel 43 can be utilized. In the first and third embodiments described, FIGS. 1–5 and FIG. 7, where the wheel 14 or 43 is molded to the backing plate 11 or 41, the wheel 14 or 43 can be worn down to tabs 21 or 45. The limitation on use in the third embodiment shown in FIG. 7, where the wheel 43 is bonded to the plate 41 with adhesive, is the depth of the centering tabs 45. Thus, in each of these embodiments only a small part of the abrasive material of the grinding wheel 14 or 43 is not usable.

Once the abrasive material of the grinding wheel is exhausted the backing plate-wheel combination can be replaced without removing any of the other components of the grinding head assembly. In the replacement procedure, bolts 19 are unscrewed sufficiently to allow the flange 12 to be slipped downwardly to disconnect the backing plate 11 from the backing plate holder 18. A new backing plate with a grinding wheel attached is then installed as described above. The bolts 19 do not have to be removed from the backing plate holder 18, and neither the backing plate holder 18 nor drive shaft D is disturbed in the replacement procedure. The procedure thus takes a relatively short time and is easy to perform.

It is clear from a consideration of the foregoing disclosure that the invention provides a backing plate assembly for a grinding head of simple and economic construction that can withstand the stresses associated with the grinding process, can be automatically centered to ensure balance, allows use of the grinding wheel to its maximum or near maximum depth, may be reused once the abrasive material of the grinding wheel is exhausted and is quickly and easily installed and replaced.

While specific embodiments have been disclosed in detail it should be understood that modifications and variations may be resorted to without departing from the spirit of the invention. For example, the shapes and angles of the various flanges and centering tabs disclosed above can be varied without departing from the spirit of the invention. Similarly, an alternative fastening means can be used for fastening the backing plate to the backing plate holder. Such modifications and variations are considered to be within the purview and scope of the present invention as defined by the following claims.

The following is claimed:

1. A grinding head assembly comprising:

a. a backing plate holder adapted to be drivingly connected for rotation with a drive shaft, said backing plate holder having a downwardly facing annular plane surface substantially perpendicular to the axis of rotation of said drive shaft and an outermost peripheral edge symmetrically oriented about said axis;

b. an annular backing plate having an upwardly facing annular plane surface and an outer flange extending upwardly from said backing plate annular plane surface, said outer flange having an exposed outer sidewall and an internal sidewall defining an upwardly facing backing plate holder receiving cavity; said outer flange having a plurality of upwardly facing notches disposed thereon c. an annular grinding wheel permanently mounted to an underside of said plane surface of said backing plate and having an inner wall; and d. means for fastening said outer flange of said backing plate to said peripheral edge of said backing plate holder including threaded securing means abuttable against said backing plate flange exposed outer sidewall extending through said upwardly facing notches and securable to said peripheral edge of said backng plate holder for urging said backing plate flange internal sidewall into tight frictional engagement with said backing plate holder outer peripheral edge, e. said backing plate holder being received within said backing plate holder receiving cavity in a tight fit whereby said backing plate is inherently centered by said holder relative to said axis of rotation.

2. The grinding head assembly of claim 1, said backing plate flange being cylindrical, said backing plate including a strengthening cylindrical inner flange spaced inwardly from said outer flange.

3. The grinding head assembly of claim 2, said inner flange extending downwardly in fitting contact with said grinding wheel inner wall.

4. The grinding head assembly of claim 1, said backing plate including a plurality of downwardly extending anchor tabs, said grinding wheel being penetrated in holding relationship by said tabs.

* * * * *